US006722820B2

(12) United States Patent
Marshall

(10) Patent No.: US 6,722,820 B2
(45) Date of Patent: Apr. 20, 2004

(54) METHOD FOR INSTALLING GROUT WITHIN A PILING

(76) Inventor: Frederick S. Marshall, 1710 Cove Meadow Ct., Arlington, TX (US) 76012

( * ) Notice: Subject to any disclaimer, the term of this patent is extended or adjusted under 35 U.S.C. 154(b) by 35 days.

(21) Appl. No.: 10/081,951

(22) Filed: Feb. 22, 2002

(65) Prior Publication Data

US 2003/0161691 A1 Aug. 28, 2003

(51) Int. Cl.[7] ..... E02D 5/30; E02D 5/34; E02D 7/00

(52) U.S. Cl. ..... 405/233; 405/232; 405/266

(58) Field of Search ..... 405/231, 232, 405/233, 235, 236, 239, 249, 256, 257, 266

(56) References Cited

U.S. PATENT DOCUMENTS 996,397 A * 6/1911 Breuchaud ..... 405/231
3,618,328 A * 11/1971 Nojima ..... 405/244
3,685,302 A * 8/1972 Fuller ..... 405/237
4,127,990 A * 12/1978 Morrow ..... 405/36
4,768,900 A * 9/1988 Burland ..... 405/244
5,399,055 A 3/1995 Dutton, Jr.
5,505,561 A * 4/1996 Willcox, III ..... 405/251
5,713,701 A 2/1998 Marshall

* cited by examiner

*Primary Examiner*—Jong-Suk Lee
*Assistant Examiner*—Lisa M. Saldano

(57) ABSTRACT

A method for securing piling segments together to form a single foundation piling using an alignment securing assembly and vibrations sent through the piling as. Piling segments are driven into the ground on top of each other, forming a piling. A single piling passageway is formed when the piling segments are in alignment. An alignment securing assembly is placed in the passageway. Vibrations are sent through the piling so that grout will not gather in the upper portions of the passageway before the lower portions of the passageway are filled with grout. The grout cures and the piling segments are secured so that the segments will not slip. The alignment securing assembly uses an anchoring device that is lowered and set in the passageway so that tension can be applied by a cable. The tension from the cable and anchoring device causing a compressive effect on the piling.

8 Claims, 2 Drawing Sheets

METHOD FOR INSTALLING GROUT WITHIN A PILING

FIELD OF THE INVENTION

The invention relates generally to a method and apparatus used in underground pilings in the field of foundation repairs, for aiding a grouting substance to continue flow down a piling passageway rather than collecting in an upper portion of the passageway.

DESCRIPTION OF THE RELATED ART

One of the older methods for repairing foundations of buildings having slab-on-ground foundations uses drilled underground piers. Holes are drilled approximately eight to twelve feet in depth and filled with concrete. After the concrete has dried, jacks are placed on top of the pier and the foundation is brought to a level position. The jack is replaced by blocks, shims, and grout. A less expensive method is the use of driven precast solid concrete cylindrical pile sections, which are approximately one foot in height and six inches in diameter. These sections are driven into the earth one on top of the other to form a column or stack of concrete cylinders. The depth to which the bottom of the pier is driven into the earth depends upon the type of soil and zone of the seasonal moisture change. A cylinder having a larger diameter, or a pile cap, is a placed on top of the previously driven sections. Jacks are placed on top of the pile cap and the foundation is lifted.

The precast pile method relies upon the skin friction with the soil for its strength. It has the advantage of being faster since the concrete does not have to cure and precasting allows better control of concrete strength. A major disadvantage is that the one foot cylindrical sections may shift and become misaligned. Different methods have been proposed for maintaining alignment between sections. One of the methods involves pouring a grouting substance into a passageway running through all the piling segments. The grouting material sometimes collects along the passageway before the grout has filled the portions of the passageway below the collecting grout. The collecting grout causes the area though which the grout can flow to narrow and close, thereby preventing the grout from filling the entire passageway. Without the grout filling the entire passageway, the piling segments having passageways that the grout could not fill are able to slip out of alignment.

SUMMARY OF THE INVENTION

The method in this invention is used for securing a plurality of piling segments together in order to form a foundation piling. Piling segments are driven into the ground on top of each other to form a piling. The number of piling segments is a function of the type of earth and the relative water levels of the surrounding area. The piling segments each have a passageway running axially through the segments that aligns so that there is a single passageway running through the piling. The segments are secured by an alignment securing assembly so the segments do not slip or move out of alignment after the piling segments are driven into the ground. The segments may have an outer metallic sleeve that extends around the circumference of the piling segments.

Vibrations are sent through the piling. Grout is poured into the passageway to increase the compressive and tensile strength of the piling. Grout is prevented from collecting in upper portions of the passageway before the grout fills the portions of the passageway below. One means of producing the vibrations sent through piling is forming a hole along side the piling and placing a vibration rod into the hole so that the lower portion of the rod is substantially in contact with the upper portion of the piling. The upper end of the vibration rod is connected to a vibratory device, which sends vibrations through the vibration rod and causes the vibration rod to vibrate substantially against the piling. Another means of preventing the grout from collecting in the upper portions of the passageway is to place a support member in the passageway and then send vibration through the support member with a vibration rod that is substantially in contact with the support member.

One of the alignments securing assemblies is an anchoring device. The anchoring device in this invention is used to in conjunction with a cable in tension to apply compression to a foundation piling. The compressive state of the foundation piling helps to prevent the individual segments of the foundation piling from slipping or sliding out of alignment. The anchoring device is suspended by a cable into a piling passageway running through all the piling segments. After the anchoring device is lowered to a desired depth, a weight is dropped onto the anchoring device. The force of the weight hitting the anchoring device causes the anchoring device to expand and grip the passageway of the piling. The surface of the anchoring device is textured to prevent the anchoring device from slipping from the piling. A piling assembly is defined with the piling segments and the cable once the cable is anchored to the piling in the piling passageway with anchoring device.

Then tension is applied to the cable. The upward force from the tension is communicated through the anchoring device and into the piling. The upward forces exerted on the lower portion of the piling causes a compressive effect between the upper portion of the piling and the lower portion of the piling. This state of compression helps to prevent the piling segments from sliding relative to each other.

DETAILED DESCRIPTION OF THE PREFERRED EMBODIMENTS

Figure 1:
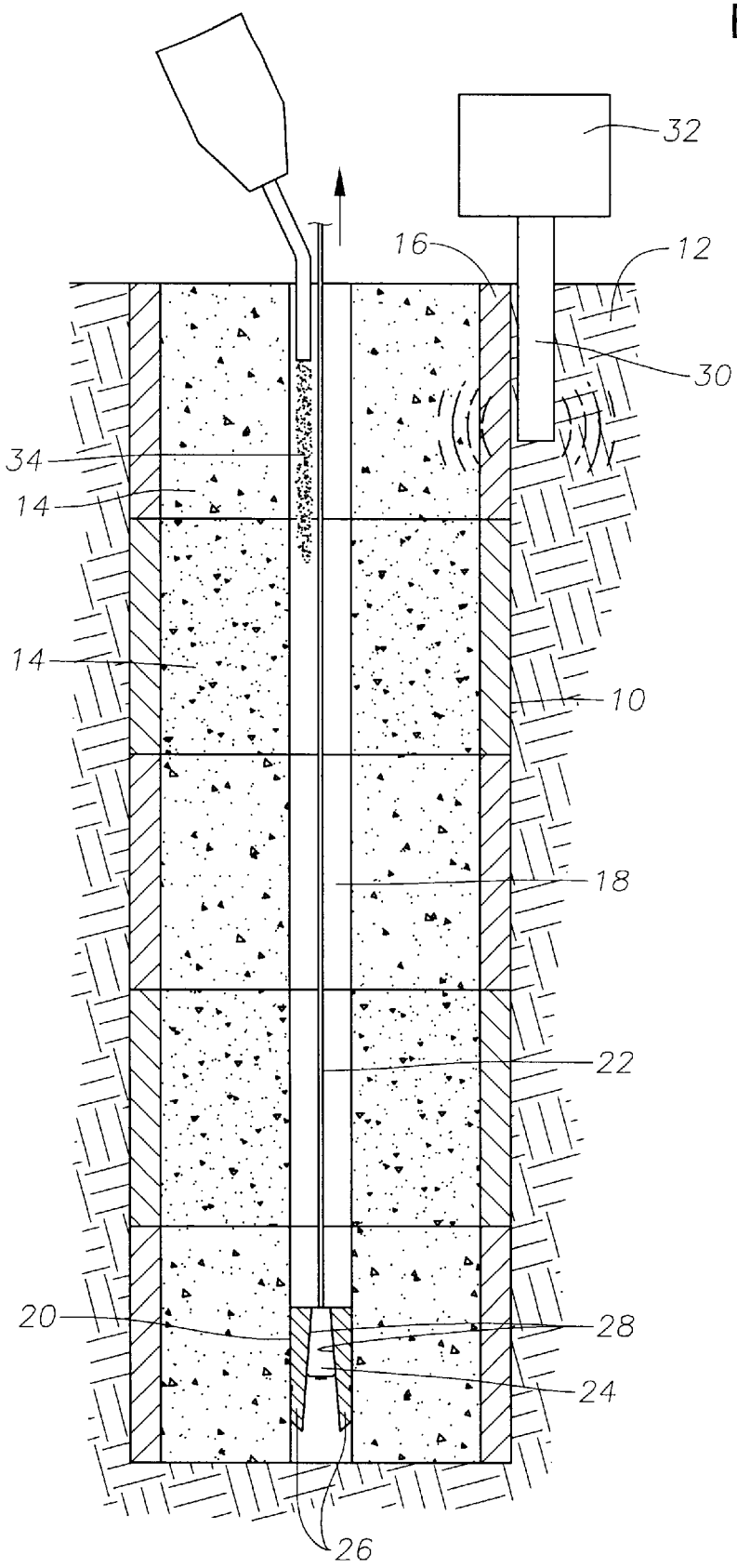
FIG. 1 is a cross-sectional view of a piling installation assembly constructed in accordance with this invention.

Referring to FIG. 1, a piling 10 is shown already driven into the ground 12. Piling 10 is made by driving a series of individual piling segments 14 into ground 12. Piling segments 14 are driven into ground 12 one on top of each other until piling 10 is the desired depth, which is determined by the factors like type of soil and water levels. Piling segments 14 can be pre-cast concrete cylinders. In the preferred embodiment, piling segments have a sleeve 16 surrounding piling segments 14. Sleeve 16 can be metallic or any material that is capable of a high frequency of impacts on a small area better than concrete. A passageway 18 runs axially through each piling segment 14 so that when piling segments 14 align, passageway 18 runs axially completely through piling 10.

An alignment securing assembly is placed into passageway 18 after piling 10 is driven into ground 12 to the desired depth. The alignment securing assembly in FIG. 1 is an anchoring device 20 that is attached to a support member, preferably a cable 22. Anchoring device 20 has a centerpiece 24, which is attached to cable 22, and at least one wing or wedge 26 connected to centerpiece 24 by a retaining device 28. In the embodiment shown in FIG. 1, anchoring device 20 has two wings 28. Retainer device (not shown) holds wings 26 to centerpiece 24 while anchoring device 20 is lowered into passageway 18. Wings 26 protrude above centerpiece 24 in an initial width position when held by retainer device (not shown). A weight (not shown) drops onto anchoring device 20, colliding with wings 26, and forcing retainer device (not shown) to disengage from anchoring device 20.

Centerpiece 24 has tapered sides 28. Tapered sides 28 angle so that the upper portion of centerpiece 24 is thinner than the lower portion of centerpiece 24. The force of the weight dropped onto wings 26 also pushes wings 26 down the sides of centerpiece 24. Therefore, the width of anchoring device 20 increases as wings 26 slide down tapered sides 28. Anchoring device is in its increased width position after the weight pushes wings 26 down tapered sides 28. Wings 26 dig into the inner surface of passageway 18, securing anchoring device to piling 10, when anchoring device 20 is in its increased width position.

A vibration rod 30 is placed so that the lower portion of vibration rod 30 is substantially in contact with the external surface of piling 10. In the preferred embodiment, the external surface of metal sleeve 16 is the external surface of piling 10. A vibratory device 32 is connected to the upper portion of vibration rod 30. Vibratory device 32 creates a series of mechanical vibrations, which are transferred to vibration rod 30. Vibration rod 30 vibrates when vibratory device is engaged. The lower portion of vibration rod 30 vibrates substantially against sleeve 16. The vibrations from vibration rod 30 are transferred to sleeve 16, the vibrations then reverberate through piling 10.

In the preferred embodiment, a hole is created substantially alongside the upper portion of piling 10 to a desired depth. Vibration rod 30 is placed into the hole alongside the upper portion of piling 10 so that the lower portion of vibration rod is in substantial contact with piling 10.

Referring back to FIG. 1, a grout 34 is poured into passageway 18 to reinforce piling 10. In the preferred embodiment, grout 34 flows down passageway 18 surrounding cable 22 and anchoring device 20. The vibrations reverberating through piling 10 from vibration rod 30 communicate to the surface of passageway 18. The vibrations felt on the surface of passageway 18 help to prevent grout 34 from collecting on the surface of passageway 18 before portions of passageway 18 below are filled.

Tension is applied to cable 22 after grout 34 fills passageway 18. The tension translates an upward force through anchoring device 20 into piling segments 14 in the lower portion of piling 10. The combination of the upward force from the tension applied to the cable and the gravitation force on the piling segments 14 creates a compressive effect on the piling segments 14. The compressive effect on piling segments 14 prevents piling segments 14 from slipping out of alignment before grout 34 cures. Piling segments 14 remain under compression once grout 34 cures even without further tension on cable 22.

In operation, the operator drives a series of piling segments 14 into the ground to make a piling 10. In the preferred embodiment, piling segments have sleeve 16 made of metal. Anchoring device 20, while in its initial width position, is lowered into passageway 18 to a desired depth. A weight (not shown) is dropped onto wings 26, forcing wings 26 to slide down tapered sides 28, thereby forcing anchoring device into its expanded width position. Wings 26 gripping the surface of passageway 18 while forced down tapered sides 28, and securing anchoring device 20 to piling 10.

A hole is created substantially alongside the upper potion of piling 10. The operator places vibration rod 30 into the hole so that the lower portion of vibration rod 30 is in substantial contact alongside the upper portion of piling 10. In the preferred embodiment, the external surface of piling 10 is sleeve 16. The opposite end of vibration rod 30 is connected to vibratory device 32. Operator engages vibratory device 32, which then sends vibrations into vibration rod 30. Vibration rod 30 vibrates substantially against piling 10, sending a series of vibrations into piling 10.

Operator pours grout 34 into passageway 18 around cable 22. Grout 34 may be any type of cement or other bonding material. Grout 34 flows down passageway 18, around cable 22 and anchoring device 20 to the lowermost portion of passageway 18. The vibrations on the surface of passageway 18 prevent grout 34 from settling and collecting on the surface of passageway 18 until the portion of passageway 18 below is filled with grout 34. When full, the operator stops pouring grout 34 and disengages vibratory device 32. Tension is applied to cable 22, causing an upward force to be exerted upon both anchoring device 20 and piling 10. A compressive effect is created between piling segments 14 because of the tension applied to cable 22. Piling segments 14 remain under compression once grout 34 cures even without further tension on cable 22.

In a piling installation with an alignment securing assembly made in accordance with this method, anchoring device 20 and the tension of cable 22 create a compressive force on piling 10, thereby preventing segments 14 from slipping or sliding out of alignment. Piling segment 14 should not slide or shear across the surface of another piling segment when secured in accordance with this method. Grout 34 is prevented from collecting and accumulating on the surface of passageway 18 because the surface of passageway 18 is vibrating from the vibrations transferred from vibratory device 32 to vibration rod 30, through sleeve 16 and into piling 10.

Figure 2:
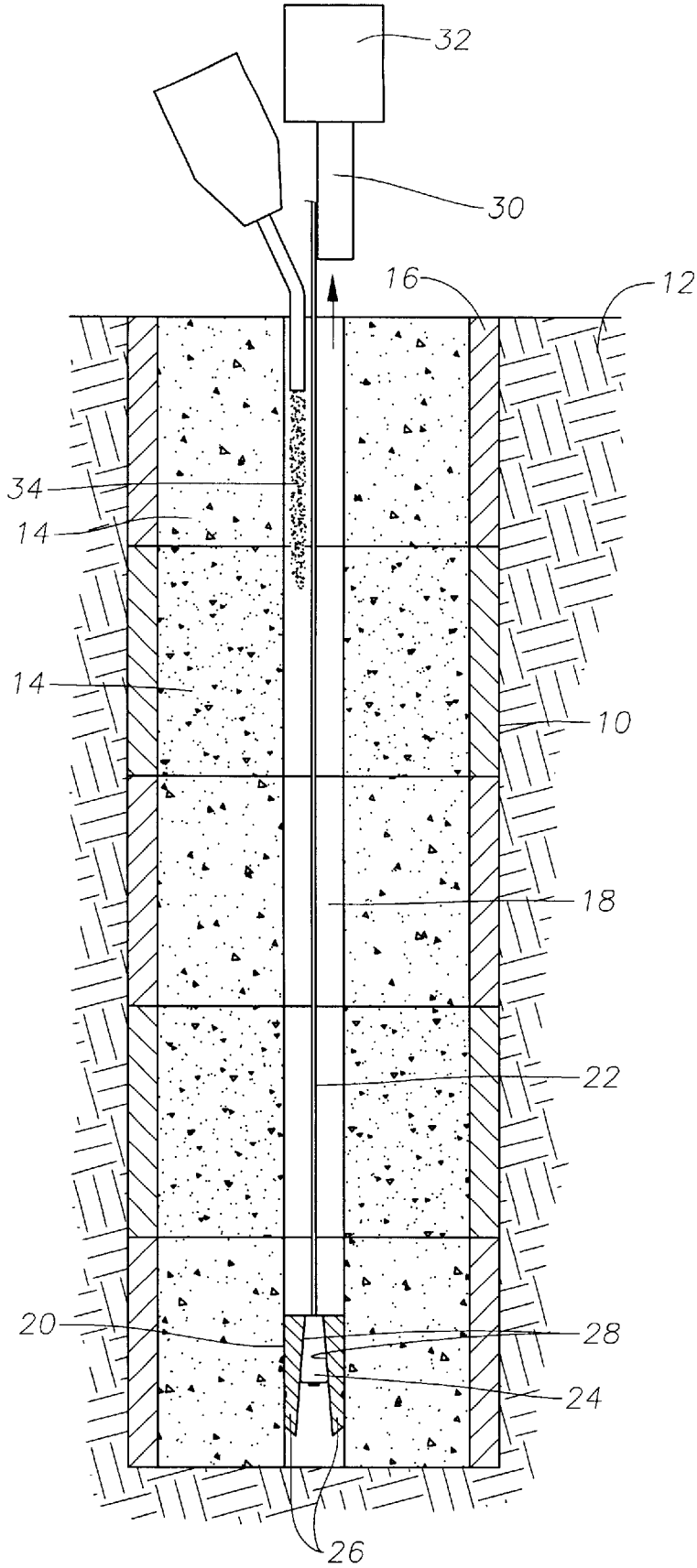
FIG. 2 is a cross-sectional view of an alternative embodiment of the piling installation assembly shown in FIG. 1.

Referring to FIG. 2, in a second embodiment the lower portion of vibration rod 30 is placed in substantial contact with cable 22 above piling 10. A hole (29 in FIG. 1) is not created. The lower end of vibration rod is too large in diameter to slide into passageway 18 alongside of cable 22. Vibration rod 30 sends vibrations through cable 22, which vibrates inside of passageway 18. Operator pours grout 34 into passageway 18 around cable 22. Grout 34 may be any type of cement or other bonding material. Grout 34 flows down passageway 18, around vibrating cable 22 and anchoring device 20 to the lowermost portion of passageway 18. The vibrations from cable 22 prevent grout 34 from settling and collecting in passageway 18 until the portion of passageway 18 below is filled with grout 34. When full, the operator stops pouring grout 34 and disengages vibratory device 32

Further, it will also be apparent to those skilled in the art that modifications, changes and substitutions may be made to the invention in the foregoing disclosure. Accordingly, it is appropriate that the appended claims be construed broadly and in the manner consisting with the spirit and scope of the invention herein.

What is claimed is:

1. A method for installing a piling assembly, comprising:

(a) driving a plurality of piling segments into the earth, one above the other to define a piling assembly, wherein the piling has a piling passageway running axially therethrough;

(b) pouring a grout into the passageway;

(c) inserting an alignment securing assembly in the piling passageway to an interior surface of the piling passageway with a portion extending above the piling passageway; and (d) placing a vibration rod with a portion being in substantial contact with the portion of the alignment securing assembly extending above the piling passageway and causing the vibration rod to vibrate.

2. A method for installing a piling assembly, comprising:

(a) driving a plurality of piling segments into the earth, one above the other to define a piling assembly, wherein the piling has a piling passageway running axially therethrough and an alignment securing assembly in the piling passageway and extending above the piling passageway;

(b) placing a vibration rod so that a portion of the vibration rod is in substantial contact with a portion of the piling assembly;

(c) pouring a grout into the passageway;

(d) causing the vibration rod to vibrate against the piling assembly to prevent the grout from collecting in the upper portion of the piling before the lower portion is filled with grout; and wherein the alignment securing assembly is inserted into the passageway by:

(i) suspending an anchoring device, on the end of a cable which the anchoring device is attached, into the passageway to a desired depth;

(ii) securing the anchoring device to the interior surface of the piling passageway.

3. The method of claim 2, wherein the anchoring device has an initial width position and an expanded width position; and the anchoring device is secured to the piling in step (ii) by dropping a weight onto the anchoring device to force the anchoring device into its expanded position.

4. A method for installing a piling assembly, comprising:

(a) driving a piling comprising a metal sleeve surrounding a plurality of segments into the earth, wherein the piling has a piling passageway running axially therethrough;

(b) pouring a grout into the passageway, the vibrations reverberating through the piling to prevent the grout from collecting in the upper portion of the passageway until the grout fills the lower portion of the passageway;

(c) inserting an alignment securing assembly into the passageway to maintain the alignment of the piling segments by:

(i) suspending an anchoring device, on the end of a cable which the anchoring device is attached, into the passageway to a desired depth;

(ii) securing the anchoring device to the interior surface of the piling passageway; and (d) causing a series of vibrations to reverberate throughout the piling.

5. The method of claim 4, wherein the anchoring device has an initial width position and an expanded width position; and the anchoring device is secured to the piling in step (b)(ii) by dropping a weight onto the anchoring device to force the anchoring device into its expanded position.

6. The method of claim 4, wherein step (c) comprises placing a vibration rod in substantial contact with the cable.

7. A piling installation, comprising:

a piling defined by a plurality of piling segments, adapted to be driven into the earth, one segment above the other;

a passageway running axially through each piling segment;

a grout that is poured into the passageway to add support to the piling; and a vibration rod in substantial contact with the piling during pouring of the grout, which causes a series of vibrations to reverberate though the piling to prevent grout accumulation in the upper portion of the passageway before the grout fills the lower portion;

a cable; and an anchoring device attached to the lower portion of the cable, which has an initial width position and an expanded width position, which is lowered into the piling passageway and secured to the interior surface of the piling passageway.

8. The piling installation of claim 7, wherein the anchoring device is secured to the piling by dropping a weight onto the anchoring device to force the anchoring device into its expanded position.

* * * * *